US011713888B2

(12) United States Patent
Liu et al.

(10) Patent No.: US 11,713,888 B2
(45) Date of Patent: Aug. 1, 2023

(54) COMPRESSOR AND AIR CONDITIONER SYSTEM

(71) Applicant: GREE ELECTRIC APPLIANCES, INC. OF ZHUHAI, Guangdong (CN)

(72) Inventors: Xingru Liu, Zhuhai (CN); Bo Zheng, Zhuhai (CN); Xiangfei Liang, Zhuhai (CN)

(73) Assignee: GREE ELECTRIC APPLIANCES, INC. OF ZHUHAI, Guangdong (CN)

( * ) Notice: Subject to any disclaimer, the term of this patent is extended or adjusted under 35 U.S.C. 154(b) by 295 days.

(21) Appl. No.: 17/049,935

(22) PCT Filed: Jan. 30, 2019

(86) PCT No.: PCT/CN2019/073948

§ 371 (c)(1),
(2) Date: Oct. 22, 2020

(87) PCT Pub. No.: WO2019/242311

PCT Pub. Date: Dec. 26, 2019

(65) Prior Publication Data

US 2021/0102714 A1 Apr. 8, 2021

(30) Foreign Application Priority Data

Jun. 22, 2018 (CN) ..... 201810654923.7

(51) Int. Cl.
*F24F 1/029* (2019.01)
*F25B 41/20* (2021.01)
(Continued)

(52) U.S. Cl.
CPC ..... *F24F 1/029* (2019.02); *F24F 1/022* (2013.01); *F25B 31/00* (2013.01); *F25B 41/20* (2021.01); *F25B 41/30* (2021.01); *F25B 41/40* (2021.01)

(58) Field of Classification Search
CPC . F24F 1/022; F24F 1/029; F25B 41/20; F25B 41/30; F25B 41/40; F25B 31/00;
(Continued)

(56) References Cited

U.S. PATENT DOCUMENTS 4,475,360 A * 10/1984 Suefuji ..... F04C 18/0215 62/503
8,356,986 B2 * 1/2013 Higashi ..... F04C 18/322 417/310
(Continued)

FOREIGN PATENT DOCUMENTS

CN 204877945 U 12/2015
CN 105221421 A 1/2016
(Continued)

OTHER PUBLICATIONS

English machine translation of CN-107228070-A (Year: 2017).*
(Continued)

*Primary Examiner* — Miguel A Diaz
(74) *Attorney, Agent, or Firm* — J. Miguel Hernandez; James R. Gourley; Carstens, Allen & Gourley, LLP

(57) ABSTRACT

A compressor includes: a first cylinder, the first cylinder being provided with a first gas intake and a first gas outlet, the first air outlet being connected to a predetermined heat exchanger; a second cylinder, the second cylinder being provided with a second gas intake and a second gas outlet, and the second gas outlet being connected to the predetermined heat exchanger; and a gas pre-exhausting device. The gas pre-exhausting device is provided on a cylinder block of the first cylinder or on an upper end surface of the first cylinder or a lower end surface of the first cylinder; the gas pre-exhausting device includes a gas pre-exhausting port and a first control valve controlling the gas pre-exhausting port to be open or closed; and the gas pre-exhausting port is
(Continued)

connected to the second gas intake. Further disclosed is an air conditioner system including the compressor.

19 Claims, 8 Drawing Sheets

(51) Int. Cl.

| | |
|---|---|
| ***F25B 41/40*** | (2021.01) |
| ***F25B 41/30*** | (2021.01) |
| ***F24F 1/022*** | (2019.01) |
| ***F25B 31/00*** | (2006.01) |

(58) Field of Classification Search
CPC ..... F04C 11/00; F04C 23/00; F04C 15/06; F04C 15/064; F04C 29/12; F04C 29/124; F04C 28/065; F04C 14/10; F04C 14/24; F04C 14/26
See application file for complete search history.

(56) References Cited

U.S. PATENT DOCUMENTS

| | | | | |
|---|---|---|---|---|
| 2007/0041852 | A1* | 2/2007 | Masuda | F04C 23/008 417/410.3 |
| 2010/0111737 | A1* | 5/2010 | Higashi | F04C 23/001 418/11 |
| 2015/0159919 | A1* | 6/2015 | Sato | F04B 53/08 62/498 |
| 2021/0003321 | A1* | 1/2021 | Friedrich | F04B 35/04 |

FOREIGN PATENT DOCUMENTS

| | | | | | |
|---|---|---|---|---|---|
| CN | 105864038 | A | | 8/2016 | |
| CN | 107228070 | A | * | 10/2017 | F04C 18/3562 |
| CN | 108533490 | A | | 9/2018 | |
| CN | 112112803 | A | * | 12/2020 | |
| EP | 1746289 | A1 | * | 1/2007 | F04C 18/045 |
| EP | 2110556 | A1 | | 10/2009 | |
| EP | 2336675 | A1 | * | 6/2011 | F04C 18/322 |
| GN | 101532493 | A | | 9/2009 | |
| GN | 102588285 | A | | 7/2012 | |
| GN | 105114320 | A | | 12/2015 | |
| JP | 2003148365 | A | | 5/2003 | |
| JP | 2004301074 | A | * | 10/2004 | F25B 1/10 |
| JP | 2010156245 | A | * | 7/2010 | |
| KR | 20070087136 | A | * | 8/2007 | |
| WO | WO-2016115901 | A1 | * | 7/2016 | |

OTHER PUBLICATIONS

English machine translation of KR-20070087136-A (Year: 2007).*
Extended European Search Report for European Application No. 19823011.2 dated Mar. 18, 2021 (6 pages).
International Search Report for Application No. PCT/CN2019/073948 dated Apr. 26, 2019 (3 pages).

* cited by examiner

COMPRESSOR AND AIR CONDITIONER SYSTEM

CROSS REFERENCE TO RELATED APPLICATION

This application claims priority to Chinese Patent Application No. 201810654923.7, filed on Jun. 22, 2018, entitled "Compressor and Air conditioner System", the entire content of which is incorporated herein by reference. This application is a national phase under 35 U.S.C. § 120 of international patent application PCT/CN2019/073948, entitled "Compressor and Air Conditioner System" filed on Jan. 30, 2019, and published as WO 2019/242311 A1 on Dec. 26, 2019. Every patent application and publication listed in this paragraph is hereby incorporated by reference in its entirety.

TECHNICAL FIELD

The present disclosure relates to a field of air conditioning technology, in particular, to a compressor and air conditioner system.

BACKGROUND

The enhanced vapor injection technology has become a key technology to solve the problem of performance degradation of rotary compressors when it is applied in cold regions. At present, the vapor injection technology commonly used in a rotary compressor is mainly double-stage enthalpy increase and double-cylinder enthalpy increase. Researches show that the double-cylinder enthalpy-increasing technology has the same vapor injection effect as the double-stage compression under working conditions of a large pressure ratio, while having a better vapor injection effect than double-stage compression under working conditions of a medium or small pressure ratio.

In related art, a volumetric ratio of a conventional double-cylinder enthalpy-increasing compressor was designed and achieved good effects, but its main problem is that the drawn gas of one cylinder of the double-cylinder enthalpy-increasing compressor all comes from the vapor injection, and the amount of the vapor injection is relatively small, and the pressure thereof belongs to a medium pressure, so a volume of such a cylinder is small, generally about one-tenth of the displacement of the other cylinder.

Obviously, a volumetric ratio of 10:1 between the two cylinders will cause a series of problems. Firstly, efficiency of a small cylinder is poor; secondly, a compressor with small displacement is more difficult to realize, because when the displacement of a compressor is small, the small cylinder is required to be very small, and is difficult to process.

In addition, the double-cylinder enthalpy-increasing compressor also has a problem of switching between different cylinder blocks in different operating modes, for the reason that the vapor injection effect is not good under working conditions of a small pressure ratio. At this time, the vapor injection valve will be turned off, and the small cylinder will need to draw gas from an outlet of an evaporator.

In related art, a device similar to a three-way valve connected outside was proposed and capable of switching a double-cylinder compressor to two modes of a single-stage operation and a double-cylinder enthalpy-increasing operation. However, in this case, a switching device needs to be provided outside the compressor, which increases the complexity of the system. Under conditions of a medium or small pressure ratio, the double-cylinder compressor has a better vapor injection effect than that of the double-stage compressor, and when the vapor is not injected, the double-cylinder compressor has performance significantly better than that of the double-stage compressor. However, the double-cylinder compressor has a parallel structure, and has poor volumetric efficiency under conditions of a large pressure ratio, so under the conditions of a large pressure ratio, the overall performance of the double-cylinder compressor is not as good as the double-stage compressor.

SUMMARY

The purpose of the present disclosure is mainly to provide a compressor and an air conditioner system, to solve a problem of small volumes of two different-sized cylinders of a double-cylinder enthalpy-increasing compressor in the prior art.

In order to achieve the purpose above, according to an aspect of the present disclosure, a compressor is provided. The compressor includes a first cylinder provided with a first gas intake and a first gas outlet, the first gas outlet being configured to be connected to a predetermined heat exchanger; a second cylinder provided with a second gas intake and a second gas outlet, the second gas outlet being configured to be connected to the predetermined heat exchanger; a gas pre-exhausting device disposed on a cylinder block of the first cylinder, or on an upper end surface of the first cylinder, or on a lower end surface of the first cylinder, The gas pre-exhausting device includes a pre-exhausting port and a first control valve that controls the pre-exhausting port to be open or closed. The pre-exhausting port is connected to the second gas intake.

According to another aspect of the present disclosure, an air conditioner system is provided, and the air conditioner system includes the compressor as described above.

Optionally, the air conditioner system further includes a gas-liquid separator, a first heat exchanger, a second heat exchanger, a first throttling element, and a second throttling element. An inlet of the first heat exchanger is connected to the first gas outlet and the second gas outlet. An outlet of the first heat exchanger is connected to an inlet of the first throttling element. An outlet of first throttling element is connected to an inlet of the gas-liquid separator. A bottom outlet of the gas-liquid separator is connected to an inlet of the second throttling element. An outlet of the second throttling element is connected to an inlet of the second heat exchanger. An outlet of the second heat exchanger is connected to the first gas intake. The first heat exchanger is the predetermined heat exchanger. A top outlet of the gas-liquid separator is connected to the second gas intake.

Optionally, the air conditioner system includes a double-cylinder enthalpy-increasing mode. When the air conditioner system is in the double-cylinder enthalpy-increasing mode, refrigerant is discharged from the first cylinders and the second cylinder of the compressor, and then is transformed into high-pressure supercooled liquid via the first heat exchange, and enters the gas-liquid separator via the first throttling element. The refrigerant is divided into two flows in the gas-liquid separator. One flow of liquid refrigerant enters the second throttling element via the bottom outlet of the gas-liquid separator and is throttled into low-pressure two-phase refrigerant, and then enters the second heat exchanger. The low-pressure two-phase refrigerant evaporates into gaseous refrigerant in the second heat exchanger, and is drawn in the first cylinder. Another flow of refrigerant gas in the gas-liquid separator is mixed with refrigerant discharged from the gas pre-exhausting device via the top outlet of the gas-liquid separator, and then is drawn in the second cylinder.

According to yet another aspect of the present disclosure, an air conditioner system is provided, and the air conditioner system includes the compressor as described above.

Optionally, the air conditioner system further includes a gas-liquid separator, a first heat exchanger, a second heat exchanger, a first throttling element, and a second throttling element, wherein, an inlet of the first heat exchanger is connected to the first gas outlet and the second gas outlet. An outlet of the second heat exchanger is connected to an inlet of the first throttling element. An outlet of first throttling element is connected to an inlet of the gas-liquid separator. A bottom outlet of the gas-liquid separator is connected to an inlet of the second throttling element. An outlet of the second throttling element is connected to an inlet of the second heat exchanger. An outlet of the second heat exchanger is connected to the first gas intake. The first heat exchanger is the predetermined heat exchanger. A top outlet of the gas-liquid separator is connected to the second gas intake.

Optionally, the air conditioner system includes a double-stage enthalpy-increasing operating mode. When the air conditioner system is in the double-stage enthalpy-increasing operating mode, the second control valve opens, and the third control valve is closed. Since a back pressure applied on a valve plate of the first control valve of the gas pre-exhausting device is always greater than a pressure in a compression chamber corresponding to a position of the pre-exhausting port, the first control valve of the gas pre-exhausting device is always closed. In the double-stage enthalpy-increasing operating mode, refrigerant discharged from the first gas outlet is mixed with refrigerant flowing out from the top outlet of the gas-liquid separator and then is drawn in the second gas intake. High-temperature and high-pressure refrigerant discharged from the second gas outlet of the compressor is condensed by the first heat exchanger and is transformed into high-pressure supercooled liquid refrigerant. The high-pressure supercooled liquid refrigerant is throttled into a two-phase refrigerant via the first throttling element and enters the gas-liquid separator. The two-phase refrigerant is divided into two flows in the gas-liquid separator. Liquid at a bottom flows out of the bottom outlet of the gas-liquid separator, and enters the second heat exchanger via the second throttling element. The liquid refrigerant evaporates into gaseous refrigerant in the second heat exchanger, and is drawn in the first cylinder. The gas refrigerant in the gas-liquid separator flows out of the top outlet of the gas-liquid separator, and is mixed with refrigerant discharged from the first cylinder, and then is drawn in the second gas intake, such that a double-stage enthalpy-increasing compression of the refrigerant is realized.

Optionally, the air conditioner system further includes a double-cylinder enthalpy-increasing operating mode. When the air conditioner system is in the double-cylinder enthalpy-increasing operating mode, the second control valve is closed, and the third control valve opens. When a pressure in a compression chamber of the first cylinder is greater than a back pressure applied on the gas pre-exhausting device, the first control valve of the gas pre-exhausting device opens, and is not closed until a first cylinder rotor of the first cylinder rotates and passes the gas pre-exhausting device. In the double-cylinder enthalpy-increasing operating mode, refrigerant is discharged from the compressor, and then is transformed into high-pressure supercooled liquid via the first heat exchanger; the high-pressure supercooled liquid enters the gas-liquid separator via the first throttling element, and is divided into two flows in the gas-liquid separator. One flow of liquid refrigerant enters the second throttling element via the bottom outlet of the gas-liquid separator and is throttled into low-pressure two-phase refrigerant. The low-pressure two-phase refrigerant enters the second heat exchanger and evaporates into gaseous refrigerant in the second heat exchanger. The gaseous refrigerant is drawn in the first gas intake. Another flow of gas refrigerant in the gas-liquid separator flows out of the top outlet of the gas-liquid separator and is mixed with refrigerant discharged from the gas pre-exhausting device, and then is drawn in the second gas intake.

It can be seen that the present disclosure provides a new type of compressor and an air conditioner system by using the advance exhaust technology. Compared with the conventional double-cylinder enthalpy-increasing compressor, the compressor of the present disclosure can greatly increase the volumes of the first cylinder and the second cylinder, which makes it easier to apply the double-cylinder enthalpy-increasing technology to the compressor with small capacity. By increasing the volumes of the first cylinder and the second cylinder, the second cylinder is effectively improved, that is, the efficiency of the small cylinder is improved, thereby realizing the improvement of performance. In addition, the present disclosure can realize free switching between the enthalpy-increasing operation and the non-enthalpy-increasing operation without providing other components additionally. Under working conditions of a small pressure ratio, part of volume of a double-cylinder compressor can be unloaded.

The compressor of the present disclosure, firstly, can switch between double-stage compression and double-cylinder independent compression, thereby combining dual advantages of double-stage low-temperature performance and double-cylinder high-temperature performance, and enabling the compressor to operate with a high efficiency under working conditions of a wide variable range. Accordingly, the operating performance of the compressor can be effectively improved. Secondly, the provided compressor can greatly increase the volume of the small cylinder during the double-cylinder operation, such that, when the double-cylinder compressor is applied to a compressor with small capacity, the processing difficulty thereof is greatly reduced. Meanwhile, because of the increase in the volume of the small cylinder, the efficiency of small cylinder can be effective improved. Thirdly, because of the arrangement of the gas pre-exhausting port, the compressor can be switched freely between the enthalpy-increasing operation and the non-enthalpy-increasing operation. Moreover, since the non-enthalpy-increasing working conditions are basically the working conditions of the low pressure ratio, the discharge from the pre-exhausting port to the second cylinder can unload part of the volume of the double-cylinder compressor.

BRIEF DESCRIPTION OF THE DRAWINGS

The accompany drawings in the specification forming a part of the present disclosure are used to provide a further understanding of the present disclosure. The exemplary embodiments and descriptions of the present disclosure are used to explain the present disclosure, but not intended to constitute an improper limitation of the present disclosure.

In which.

DETAILED DESCRIPTION OF THE EMBODIMENTS

Figure 1:
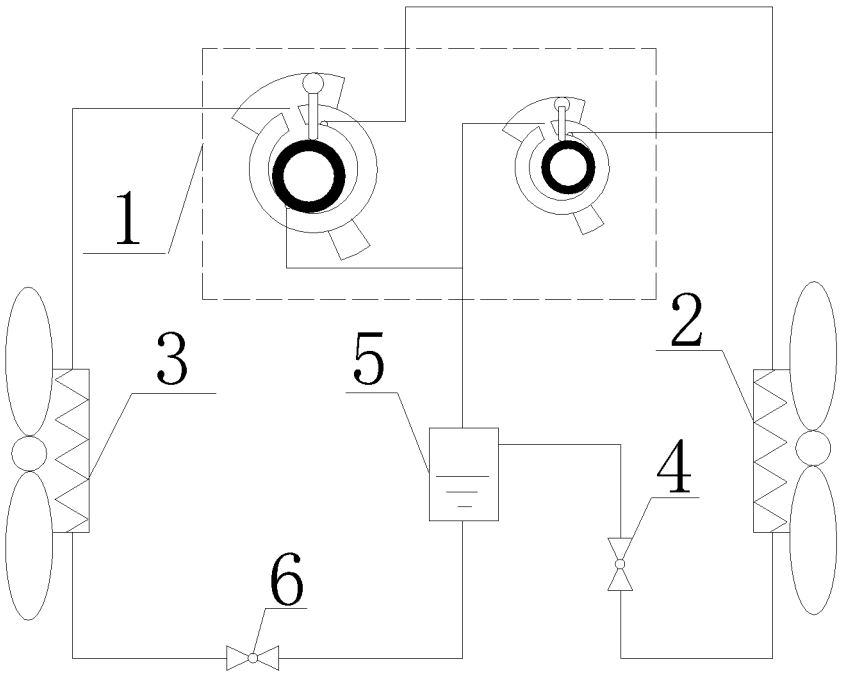
FIG. 1 schematically shows a view of connection relations in an air conditioner system according to a first embodiment of the present disclosure.

It should be specified that, the embodiments and the features in the embodiments of the present disclosure may be combined with each other if there is no conflict. The embodiments of present disclosure will be described in detail with reference to the accompanying drawings.

It should be noted that, the terminology herein is used for describing the specific embodiments, but not intended to limit the illustrative embodiments of the present disclosure. The singular terms herein are intended to include their plural unless specific descriptions are provided in context. Additionally, it should be also understood that, the terms "include" and/or "comprise" in the description refer to including the features, steps, operations, devices, components, and/or combinations thereof.

It should be specified that the terms "first", "second", etc. in the description, the claims and the drawings in the present disclosure are just used to distinguish similar objects, but not used to describe a specific order or an order of priority. It should be understood that such terms may be interchangeable under appropriate conditions, such that the embodiments of the present disclosure illustrated in the drawing or described herein can be implemented, for example, in a sequence other than the sequences illustrated or described herein. In addition, the terms "comprise", "have" and any variations thereof are intended to cover a non-exclusive inclusion. For example, a process, a method, a system, a product, or a device that includes a series of steps or units is not limited to those steps or units listed clearly, but may include other steps or units, which are not clearly listed, or which are inherent to such a process, a method, a product or a device.

For the convenience of description, terms of spatial relations such as "above", "over", "on a top surface", "upper", etc., may be used herein to describe the spatial position relationships of a device or a feature with other devices or features shown in the drawings. It should be understood that the terms of spatial relations are intended to include other different orientations in use or operation in addition to the orientation of the device described in the drawings. For example, if the device in the drawings is placed upside down, the device described as "above other devices or structures" or "over other devices or structures" will be positioned as "below other devices or structures" or "under other devices or structures". Thus, the exemplary term "above" may include both "above" and "below". The device can also be positioned in other different ways (rotating 90 degrees or at other orientations), and the corresponding explanations for the description of the spatial relations will be provided herein.

Referring to FIGS. 1 to 4 and FIGS. 10 to 15, according to a first embodiment of the present disclosure, an air conditioner system is provided. The air conditioner system in this embodiment includes a compressor 1, a first heat exchanger 2, a second heat exchanger 3, a first throttling element 4, a second throttling element 6, and a gas-liquid separator 5. Where, an inlet of the first heat exchanger 2 is connected to a first gas outlet 112 and a second gas outlet 122. An outlet of the first heat exchanger 2 is connected to an inlet of the first throttling element 4. An outlet of first throttling element 4 is connected to an inlet of the gas-liquid separator 5 of the compressor 1. A bottom outlet of the gas-liquid separator 5 is connected to an inlet of the second throttling element 6. An outlet of the second throttling element 6 is connected to an inlet of the second heat exchanger 3. An outlet of the second heat exchanger 3 is connected to a first gas intake 111. A top outlet of the gas-liquid separator 5 is connected to a second gas intake 121. The compressor 1 in this embodiment includes a first cylinder 11, a second cylinder 12, and a gas pre-exhausting device 116.

During a connection in practice, the first cylinder 11 is provided with the first gas intake 111 and the first gas outlet 112. The first gas outlet 112 is configured to be connected to the first heat exchanger 2. The second cylinder 12 is provided with the second gas intake 121 and the second gas outlet 122. The second gas outlet 122 is configured to be connected to the first heat exchanger 2. The gas pre-exhausting device 116 is disposed on a cylinder block of the first cylinder 11, or on an upper end surface (that is, on an upper flange or an intermediate partition plate) of the first cylinder 11, or on a lower end surface (on a lower flange) of the first cylinder 11. The gas pre-exhausting device 116 includes a pre-exhausting port (not shown in the figure) and a first control valve (not shown in the figure) that controls the pre-exhausting port to be open or closed. The pre-exhausting port is connected to the second gas intake 121.

The compressor 1 in this embodiment includes two operating modes, which respectively are a double-cylinder enthalpy-increasing mode and an unloaded operating mode.

Figure 2:
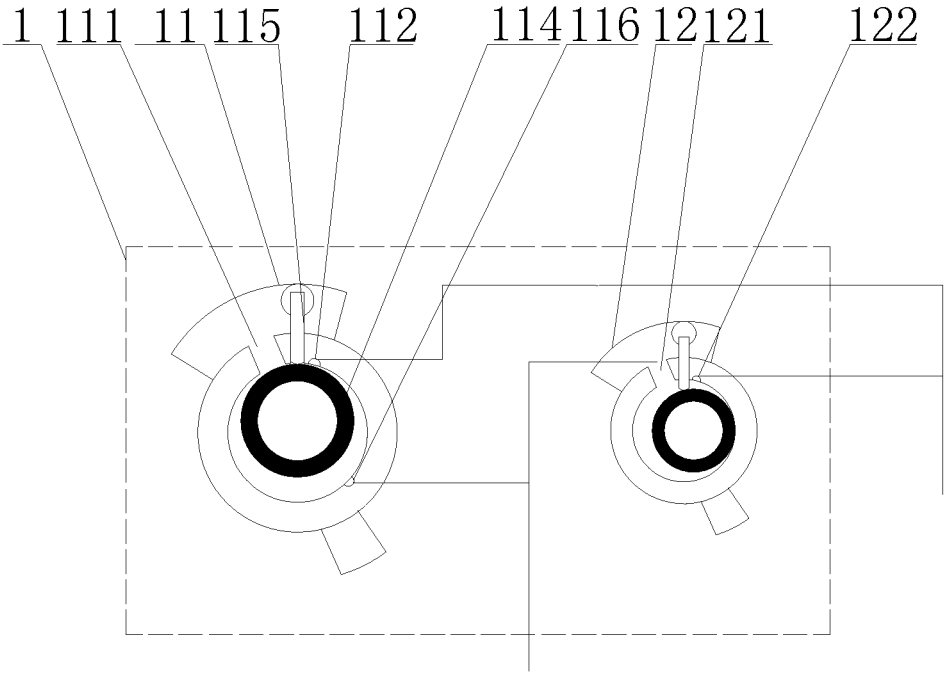
FIG. 2 schematically shows a view of connection relations in a compressor without a gas-liquid separator according to the first embodiment of the present disclosure.
Figure 3:
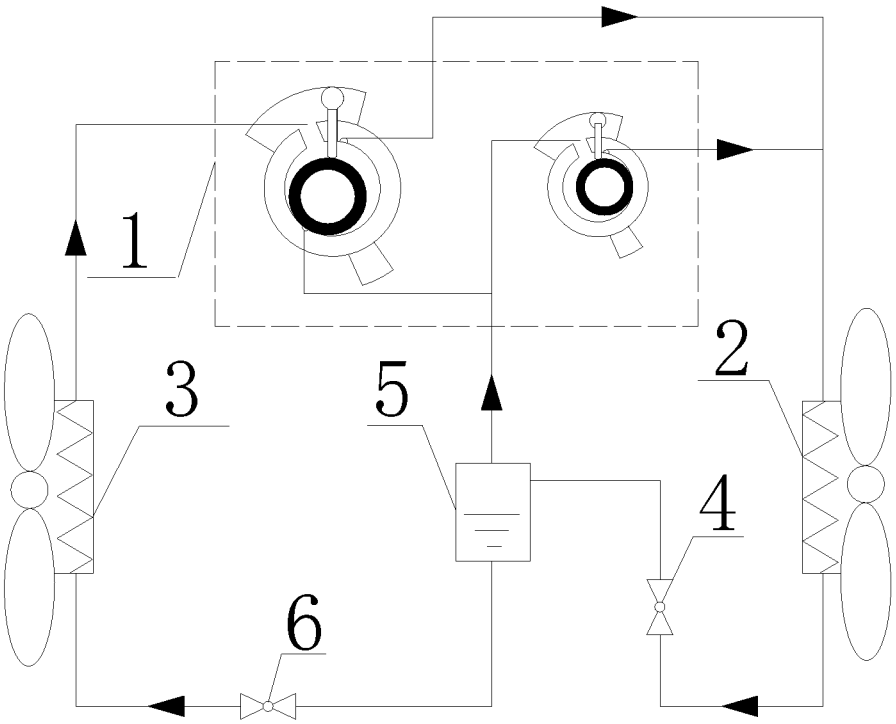
FIG. 3 schematically shows a refrigerant flow chart of the compressor in FIG. 1 when the compressor is in a double-cylinder enthalpy-increasing operating mode.
Figure 10:
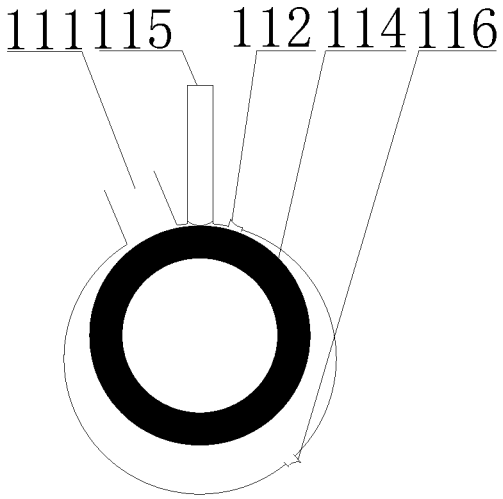
FIG. 10 schematically shows a top view of a first cylinder rotor at a starting position.
Figure 11:
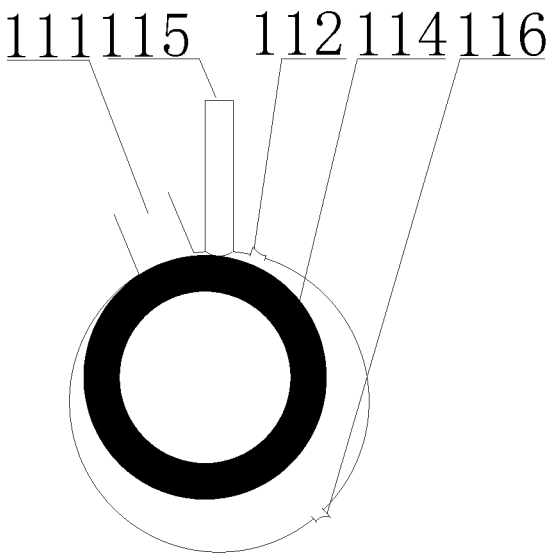
FIG. 11 schematically shows a top view of the first cylinder rotor at a closed suction position.
Figure 12:
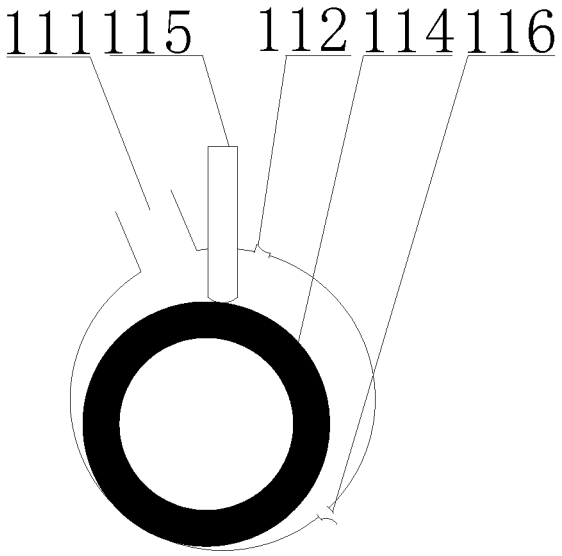
FIG. 12 schematically shows a top view of the first cylinder when a gas pre-exhausting device is in an open position according to the present disclosure.
Figure 13:
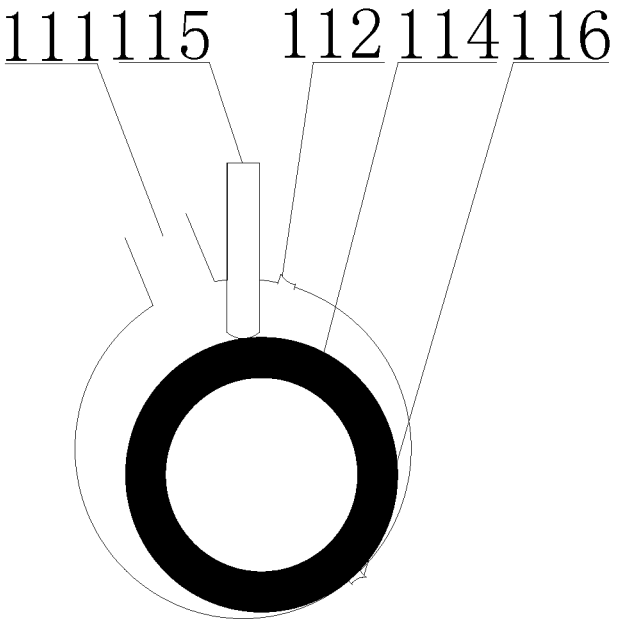
FIG. 13 schematically shows a top view of the first cylinder when the gas pre-exhausting device is in a closed position according to the present disclosure.
Figure 14:
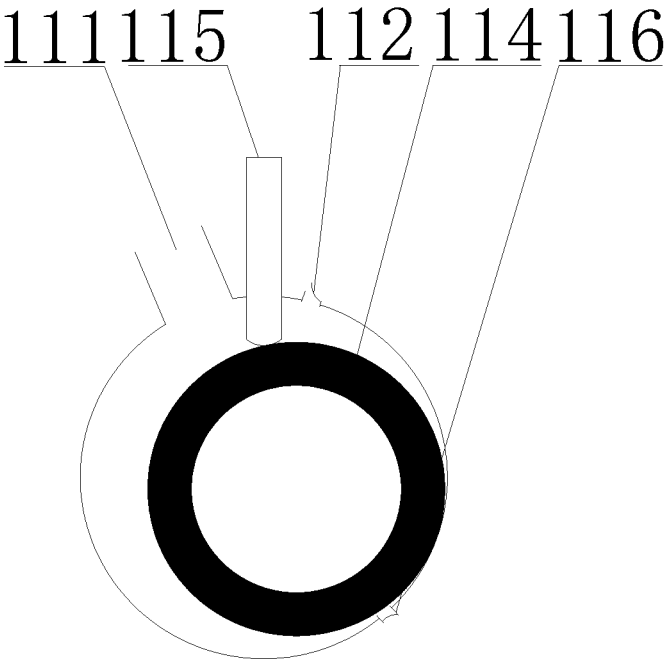
FIG. 14 schematically shows a top view of the first cylinder when the gas pre-exhausting device is in a gas exhausting starting position according to the present disclosure.
Figure 15:
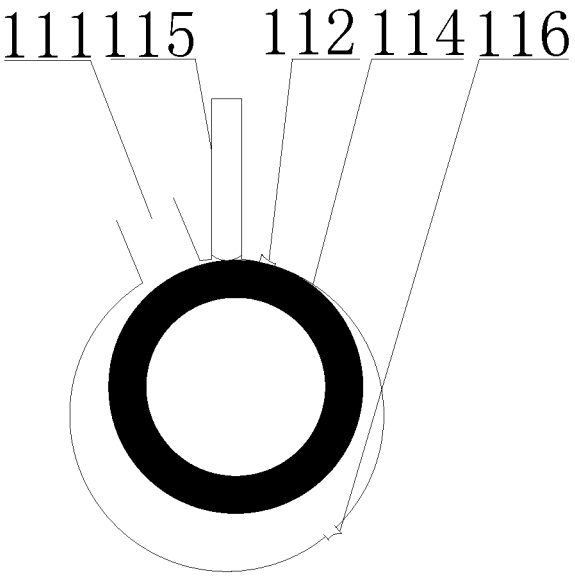
FIG. 15 schematically shows a top view of the first cylinder when the gas pre-exhausting device is in a gas exhausting ending position according to the present disclosure.

The double-cylinder enthalpy-increasing mode: as shown in FIGS. 2 and 3, refrigerant is discharged from two cylinders namely the first cylinders 11 and the second cylinder 12 of the compressor 1, and then is transformed into high-pressure supercooled liquid via the first heat exchanger 2, and enters the gas-liquid separator 5 via the first throttling element 4. The refrigerant is divided into two flows in the gas-liquid separator 5. Where, refrigerant liquid at the bottom enters the second throttling element 6 via the bottom outlet of the gas-liquid separator 5, and is throttled into low-pressure two-phase refrigerant, and then enters the inlet of the second heat exchanger 3. The low-pressure two-phase refrigerant evaporates into gaseous refrigerant in the second heat exchanger 3, and is drawn in the first gas intake 111 of the first cylinder 11. The other flow of the gas refrigerant in the gas-liquid separator 5 flows out of the top outlet of the gas-liquid separator 5, and is mixed with the refrigerant discharged from the gas pre-exhausting device 116, and then is drawn in the second gas intake 121. In this case, a compression process of the first cylinder 11 of the compressor 1 is as follows. The compression process of the first cylinder 11 of the compressor 1 starts from the moment a first cylinder rotor 114 rotates to an apex position of a first cylinder sliding vane 115, as shown in FIG. 10. Before the first cylinder rotor 114 rotates and passes the first gas intake 111, the compression process has not started. At this time, back pressure applied on the gas pre-exhausting device 116 is intermediate pressure, so the first control valve of the gas pre-exhausting device 116 is closed. When the first cylinder rotor 114 rotates from a closed suction position to a position between the closed suction position and a position where a pressure in a compression chamber reaches the intermediate pressure. Since the pressure in the compression chamber is less than the intermediate pressure, the first control valve is closed, as shown in FIG. 11. When the first cylinder rotor 114 rotates to a position where the pressure in the compression chamber is greater than the intermediate pressure, the first control valve opens, and a pre-exhausting process starts, as shown in FIG. 12. At this time, as a rotation angle increases, the pressure in the compression chamber remains unchanged, and the first control valve is still open. When the first cylinder rotor 114 rotates and passes the pre-exhausting port, the pre-exhausting process of the first cylinder 11 ends, as shown in FIG. 13. The compression chamber continues to compress. When the pressure in the compression chamber reaches an exhaust pressure, the first control valve opens, an exhaust process starts, as shown in FIG. 14. When the first cylinder rotor 114 rotates and passes the first gas outlet 112, the exhaust process ends, as shown in FIG. 15, and thus the entire cycle is completed. The compression process of the second cylinder 12 of the compressor 1 is the same as that of the existing compressor, so the redundant descriptions thereof will not be made herein.

Figure 4:
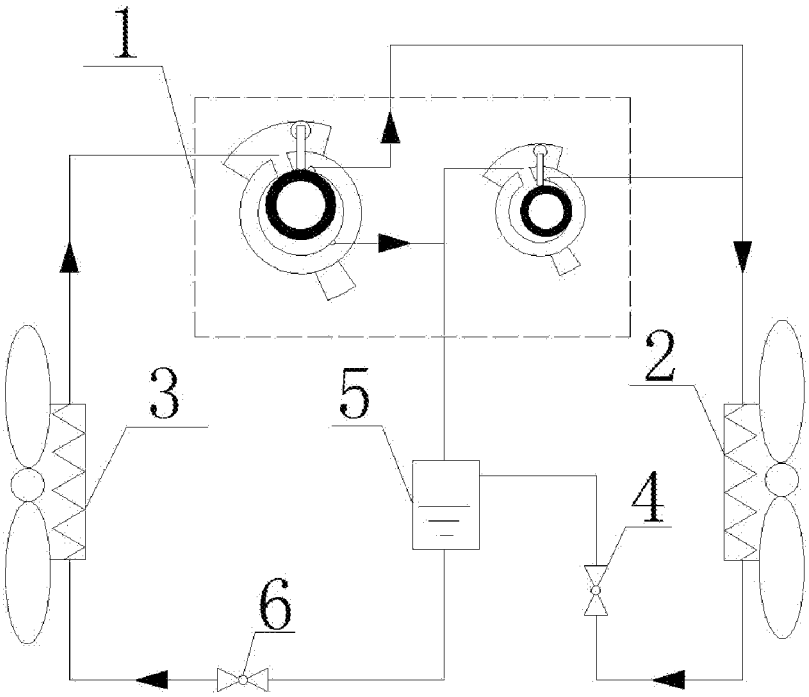
FIG. 4 schematically shows a refrigerant flow chart of the compressor in FIG. 1 when the compressor is in an unloaded operating mode.
Figure 5:
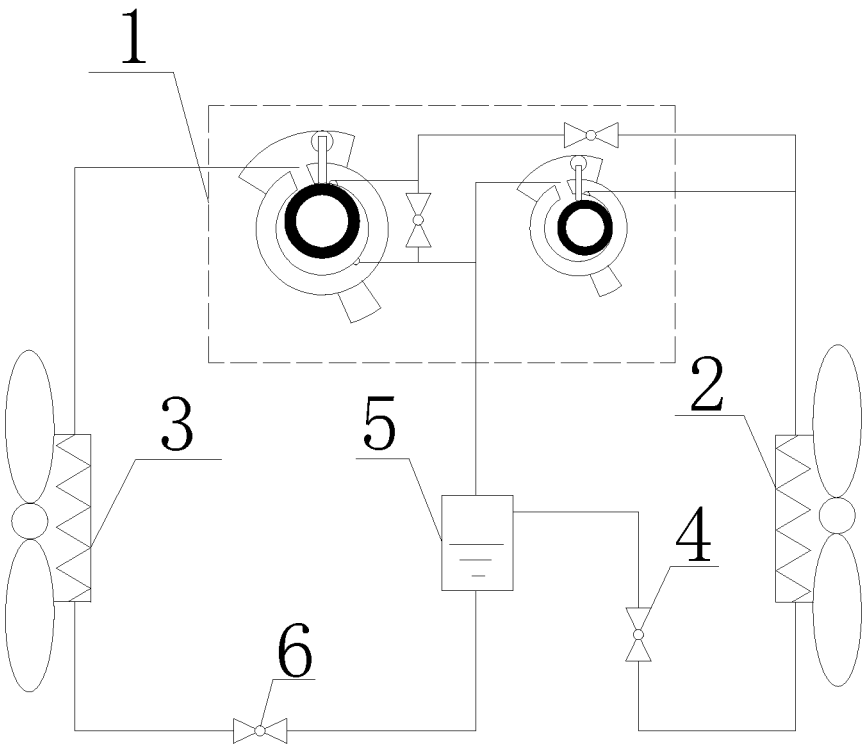
FIG. 5 schematically shows a view of connection relations in the air conditioner system according to a second embodiment of the present disclosure.
Figure 6:
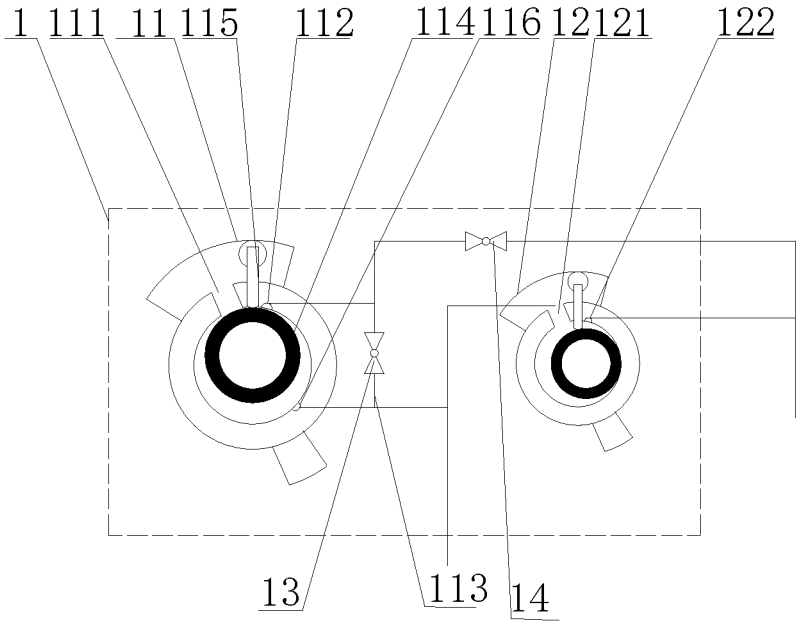
FIG. 6 schematically shows a view of connection relations in a compressor without a gas-liquid separator according to the second embodiment of the present disclosure.

The unloaded operating mode: as shown in FIG. 4, when the system is operating under working conditions of a small pressure ratio, and when the amount of gas in the gas-liquid separator 5 is small, the system is unloaded for operation. The specific implementation scheme is as follows. A vapor injection valve (not show in figures) on a vapor injection branch located on a top of the gas-liquid separator 5 is closed. High-temperature and high-pressure gaseous refrigerant is transformed into high-pressure supercooled liquid refrigerant via the first heat exchanger 2, and then enters the gas-liquid separator 5 via the first throttling element 4. Since the vapor injection valve on the gas-liquid separator 5 is closed, all refrigerant in the gas-liquid separator 5 is throttled into low-pressure two-phase refrigerant via the second throttling element 6, and then enters the second heat exchanger 3, and then evaporates in the second heat exchanger 3, and then is drawn in the first gas intake 111 of the compressor 1. Since the vapor injection valve is closed at this time, the gas of the second cylinder 12 of the compressor 1 all will be drawn from the exhausted gas of the gas pre-exhausting device 116. In this case, the back pressure of the first cylinder 11 of the compressor 1 will be depended on a position of the gas pre-exhausting device 116. When the back pressure of the compression chamber of the first cylinder 11 is greater than the suction pressure of the second cylinder 12, the first control valve opens, and is not closed until the first cylinder rotor 114 rotates and passes the pre-exhausting port. In essence, compared with the enthalpy-increasing mode, the unloaded operating mode only cuts off the vapor injection branch. However, since the refrigerant in the vapor injection branch is one of the sources of the drawn gas of the second cylinder 12, after the vapor injection branch is cut off, the suction pressure of the second cylinder 12 will be reduced. At the same time, the first control valve will open in advance. The reduction degree of the suction pressure and the opening degree of the first control valve to open the gas pre-exhausting device are coupled with each other, and are both depended on a volume ratio of the first cylinder 11 to the second cylinder 12.

It can be seen that the present disclosure provides a new type of compressor and an air conditioner system by using the advance exhaust technology. Compared with the conventional double-cylinder enthalpy-increasing compressor, the compressor of the present disclosure can greatly increase the volumes of the first cylinder 11 and the second cylinder 12, which makes it easier to apply the double-cylinder enthalpy-increasing technology to the compressor 1 with small capacity. By increasing the volumes of the first cylinder 11 and the second cylinder 12, the second cylinder 12 is effectively improved, that is, the efficiency of the small cylinder is improved, thereby realizing the improvement of performance. In addition, the present disclosure can realize free switching between the enthalpy-increasing operation and the non-enthalpy-increasing operation without providing other components additionally. Under working conditions of a small pressure ratio, part of volume of a double-cylinder compressor can be unloaded.

Optionally, the volumetric ratio of the second cylinder 12 to the first cylinder 11 in this embodiment is in the range from 0.1 to 0.5. Compared with the structure in the prior art, the second cylinder 12 in this embodiment can be manufactured larger, which is easier to process and implement.

Optionally, the first throttling element 4 and the second throttling element 6 are both throttle valves. Of course, in other embodiments of the present disclosure, the first throttling element 4 and the second throttling element 6 each may also be configured as a capillary tube. As long as they are other variants belong to the concept of the present disclosure, all of the variants fall within the protection scope of the present disclosure.

Referring to FIGS. 5 to 15, according to another embodiment of the present disclosure, an air conditioner system is provided. The air conditioner system in this embodiment has basically the same structure as the air conditioner system in the first embodiment, except that the compressor 1 in this embodiment further includes a connecting passage 113 and a switching control valve group. A first end of the connecting passage 113 is in communication with the first gas outlet 112, and a second end of the connecting passage 113 is in communication with the second gas intake 112. The switching control valve group is disposed between the first cylinder 11 and the second cylinder 12, so as to enable the compressor 1 to work in a double-stage enthalpy-increasing operating mode or a double-cylinder enthalpy-increasing operating mode or an unloaded operating mode.

Specifically, the switching control valve group includes a second control valve 13 and a third control valve 14. The second control valve 13 is disposed on the connecting passage 113 to control the connecting passage 113 to be opened or closed. The third control valve 14 is disposed on a refrigerant pipe connecting the first gas outlet 112 and the first heat exchanger 2, to control the refrigerant pipe to be opened or closed. Where, when the second control valve 13 opens, and when the third control valve 14 is closed, the first control valve is always closed because of the back pressure, and the compressor 1 is in the double-stage enthalpy-increasing operating mode. When the second control valve 13 is closed and the third control valve 14 opens, and while the pressure in the compression chamber of the first cylinder 11 is greater than the intermediate pressure of the injected vapor, the first control valve opens because of the pressure difference, and part of the refrigerant in the first cylinder 11 is discharged and drawn in the second gas intake 121 of the second cylinder 12. At this time, the compressor 1 is in the double-cylinder enthalpy-increasing operating mode. If the second control valve 13 is closed, the third control valve opens, a vapor injection valve on the vapor injection branch is closed, and the pressure in the compression chamber of the first cylinder 11 reaches the back pressure of the pre-exhausting port, then the first control valve on the pre-exhausting port opens. At this time, the compressor 1 is in the unloaded operating mode.

Optionally, the second control valve 13 and the third control valve 14 in this embodiment both are cut-off valves to prevent the refrigerant from flowing back. Of course, the one-way valve can also be any other on-off valve. The first cylinder 11 and the second cylinder 12 is any combination of rotor cylinder, piston cylinder, and scroll cylinder. The pre-exhausting port and the second gas intake 121 are connected via an internal passage of the compressor 1 or connected via a pipeline, which can be specifically arranged according to the actual structure, and the structure thereof is simple and easy to implement. The volume ratio of the second cylinder 12 to the first cylinder 11 is in the range from 0.5 to 0.7. Compared with the first embodiment, the second cylinder 12 in this embodiment can be manufactured to be larger, making it easier to process and implement the second cylinder.

The operating mode of the air conditioner system in this embodiment includes three operating modes, which respectively are a double-stage enthalpy-increasing operating mode, a double-cylinder enthalpy-increasing operating mode, and an unloaded operating mode. The operating principles of the operating modes are described as follows with reference to FIGS. 6 to 15.

Figure 7:
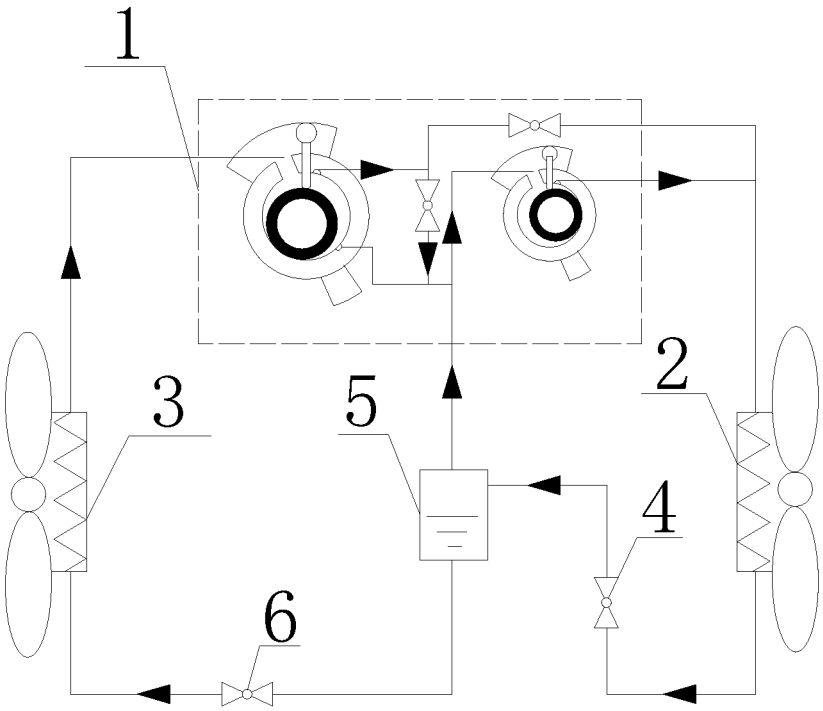
FIG. 7 schematically shows a refrigerant flow chart of the air conditioner system in FIG. 5 when the air conditioner system is in a double-stage enthalpy-increasing operating mode.

The double-stage enthalpy-increasing operating mode: FIG. 7 shows a view of a system principle of the double-stage enthalpy-increasing operating mode. In the double-stage operating mode, the second control valve 13 opens, and the third control valve 14 is closed. Since the back pressure applied on the valve plate of the first control valve of the gas pre-exhausting device 116 is always greater than the pressure in the compression chamber corresponding to the position of the pre-exhausting port, the first control valve of the gas pre-exhausting device 116 is always closed. In this mode, the refrigerant discharged from the first gas outlet 112 is mixed with the refrigerant flowing out of the top outlet of the gas-liquid separator 5, and then is drawn in the second gas intake 121 of the compressor 1. High-temperature and high-pressure refrigerant discharged from the first gas outlet 112 of the compressor 1 is condensed by the first heat exchanger 2 and transformed into high-pressure supercooled liquid refrigerant, and then is throttled into a two-phase refrigerant via the first throttling element 4, and then enters the gas-liquid separator 5. The refrigerant is divided into two flows in the gas-liquid separator 5. Liquid at the bottom flows out of the bottom outlet of the gas-liquid separator 5, and enters the second heat exchanger 3 via the second throttling element 6. The refrigerant evaporates into gaseous refrigerant in the second heat exchanger 3, and is drawn in the first gas intake 111 of the compressor 1. The gas refrigerant in the gas-liquid separator 5 flows out of the top outlet of the gas-liquid separator 5, and is mixed with the refrigerant discharged from the first cylinder 11 of the compressor 1, and then is drawn in by the second gas intake 121. The double-stage enthalpy-increasing compression of the refrigerant is realized.

Figure 8:
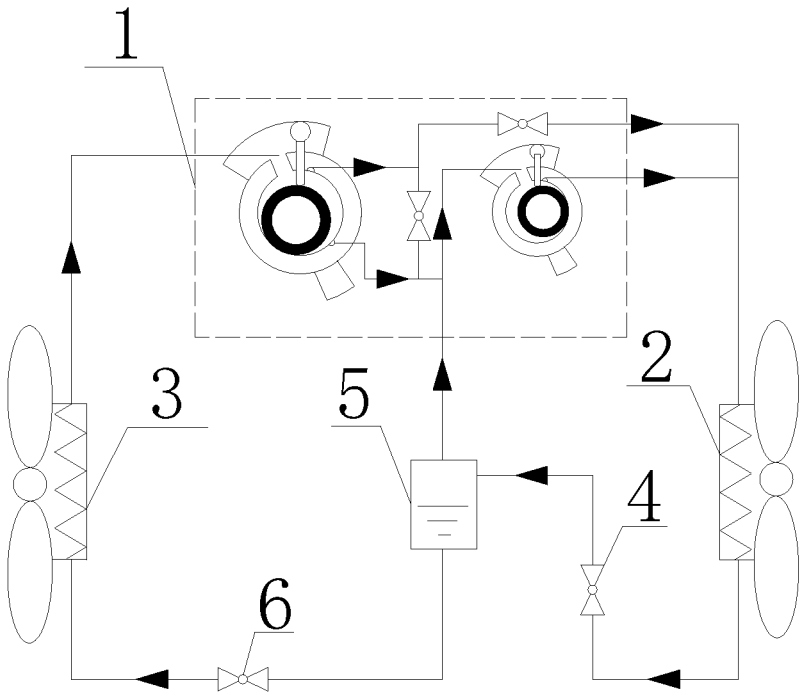
FIG. 8 schematically shows a refrigerant flow chart of the air conditioner system in FIG. 5 when the air conditioner system is in a double-cylinder enthalpy-increasing operating mode.

The double-cylinder enthalpy-increasing operating mode: FIG. 8 shows a view of a system principle when the air conditioner system is operating in the double-cylinder enthalpy-increasing operating mode. In such a mode, the second control valve 13 of the compressor is closed, and the third control valve 14 opens. Since the back pressure applied on the gas pre-exhausting device 116 is intermediate pressure, and the exhaust pressure of the first cylinder 11 is greater than the back pressure applied on the gas pre-exhausting device 116, when the pressure in the compression chamber of the first cylinder 11 of the compressor 1 is greater than the back pressure applied on the gas pre-exhausting device 116, the first control valve of the gas pre-exhausting device 116 opens, and is not closed until the first cylinder rotor 114 of the compressor 1 rotates and passes the gas pre-exhausting device 116. From the perspective of refrigerant, the refrigerant is discharged from the two cylinders of the compressor 1, and then is transformed into the high-pressure supercooled liquid via the first heat exchanger 2, and enters the gas-liquid separator 5 via the first throttling element 4, and is divided into two flows in the gas-liquid separator 5. Where, the liquid refrigerant at the bottom enters the second throttling element 6 via the bottom outlet of the gas-liquid separator 5, and is throttled into the low-pressure two-phase refrigerant, and then enters the second heat exchanger 3. The low-pressure two-phase refrigerant evaporates into gaseous refrigerant in the second heat exchanger 3, and is drawn in the first gas intake 111. The other flow of the refrigerant gas in the gas-liquid separator 5 flows out of the top outlet of the gas-liquid separator 5, and is mixed with the refrigerant discharged from the gas pre-exhausting device 116, and then is drawn in the second gas intake 121. In this case, a compression process of the first cylinder 11 of the compressor 1 is as follows. The compression process of the first cylinder 11 of the compressor 1 starts from the moment a first cylinder rotor 114 rotates to an apex position of a first cylinder sliding vane 115, as shown in FIG. 10. Before the first cylinder rotor 114 rotates and passes the first gas intake 111, the compression process has not started. At this time, back pressure applied on the gas pre-exhausting device 116 is intermediate pressure, so the first control valve of the gas pre-exhausting device 116 is closed. When the first cylinder rotor 114 rotates from a closed suction position to a position between the closed suction position and a position where the pressure in the compression chamber reaches the intermediate pressure. Since the pressure in the compression chamber is less than the intermediate pressure, the first control valve is closed, as shown in FIG. 11. When the first cylinder rotor 114 rotates to a position where the pressure in the compression chamber is greater than the intermediate pressure, the first control valve opens, and a pre-exhausting process starts, as shown in FIG. 12. At this time, as a rotation angle increases, the pressure in the compression chamber remains unchanged, and the first control valve is still open. When the first cylinder rotor 114 rotates and passes the pre-exhausting port, the pre-exhausting process ends, as shown in FIG. 13. The compression chamber continues to compress. When the pressure in the compression chamber reaches an exhaust pressure, the first control valve opens, an exhaust process starts, as shown in FIG. 14. When the first cylinder rotor 114 rotates and passes the first gas outlet 112, the exhaust process ends, as shown in FIG. 15, and thus the entire cycle is completed. The compression process of the second cylinder 12 of the compressor 1 is the same as that of the existing compressor, so the redundant descriptions thereof will not be made herein.

Figure 9:
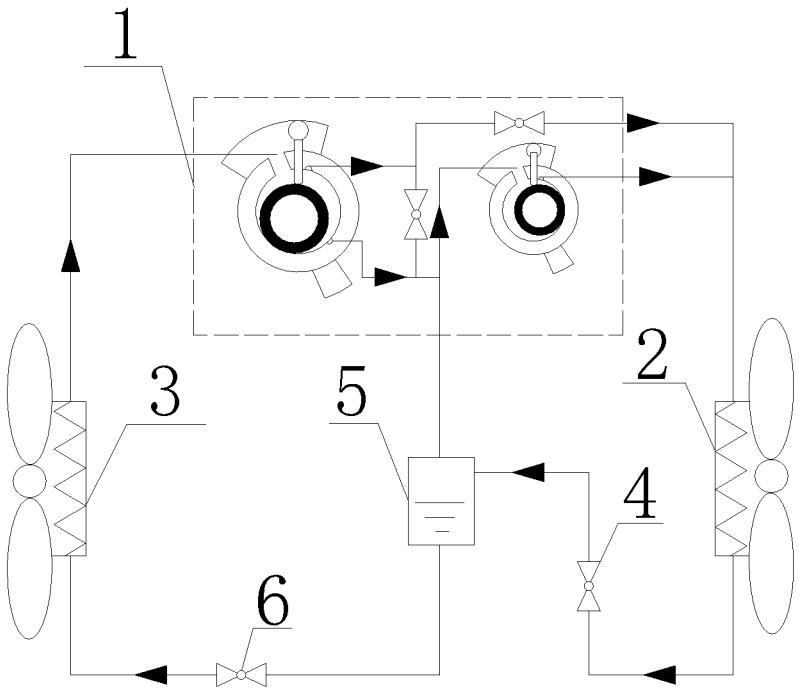
FIG. 9 schematically shows a refrigerant flow of the air conditioner system in FIG. 5 when the air conditioner system is in an unloaded operating mode.

The unloaded operating mode: as shown in FIG. 9, when the system is operating under working conditions of a small pressure ratio, and when the amount of gas in the gas-liquid separator 5 is small, the system is in the unloaded operating mode. The specific implementation scheme is as follows. A vapor injection valve on the gas-liquid separator 5 is closed. The second control valve 13 of the compressor 1 is closed, and the third control valve 14 of the compressor 1 opens. High-temperature and high-pressure gaseous refrigerant is transformed into high-pressure supercooled liquid refrigerant via the first heat exchanger 2, and then enters the gas-liquid separator 5 via the first throttling element 4 to be transformed into intermediate pressure refrigerant. Since the vapor injection valve is closed, all refrigerant in the gas-liquid separator 5 is throttled into low-pressure two-phase refrigerant via the second throttling element 6, and then enters the second heat exchanger 3, and then evaporates in the second heat exchanger 3, and then is drawn in by the first gas intake 111 of the compressor 1. Since the vapor injection valve is closed at this time, the gas of the second cylinder 12 of the compressor 1 all will be drawn from the exhausted gas of the gas pre-exhausting device 116. In this case, the back pressure of the first cylinder 11 of the compressor 1 will be depended on a position of the gas pre-exhausting device 116. When the back pressure of the compression chamber of the first cylinder 11 is greater than the suction pressure of the second cylinder 12, the first control valve opens, and is not closed until the first cylinder rotor 114 rotates and passes the pre-exhausting port. In essence, compared with the enthalpy-increasing mode, the unloaded operating mode only cuts off the vapor injection branch. However, since the refrigerant in the vapor injection branch is one of the sources of the drawn gas of the second cylinder 12, after the vapor injection branch is cut off, the suction pressure of the second cylinder 12 will be reduced. At the same time, the first control valve will open in advance. The reduction degree of the suction pressure and the opening degree of the first control valve are coupled with each other, and are both depended on the volume ratio of the first cylinder 11 to the second cylinder 12.

It can be learned from the structure of this embodiment that, this embodiment proposes the double-cylinder compressor and an air conditioner system that can be flexibly switched between single-stage, double-cylinder enthalpy-increasing and double-stage enthalpy-increasing modes by combining the advantages of double-stage enthalpy-increasing and double-cylinder enthalpy-increasing modes and the advance exhaust technology. The system can run the double-stage enthalpy-increasing mode under the working conditions of the large pressure ratio, run the double-cylinder enthalpy-increasing mode under working conditions of medium and small pressure ratios, and run the single-stage mode under the working conditions of the small pressure ratio without increasing enthalpy, thus enabling the compressor to efficiently operate under the working conditions in a large variable range.

It can be seen that the compressor of this embodiment better solves the problem of poor performance of the double-stage compressor under the conditions of a medium or small pressure ratio, and also better solves the poor volumetric efficiency and temperature of exhausted gas of the double-cylinder enthalpy-increasing compressor under the working conditions of a low temperature. Meanwhile, the double-cylinder enthalpy-increasing mode and the single-stage system can be switched freely under the working conditions of a small pressure ratio. In addition, to a certain extent, the unloaded problem of the double-cylinder enthalpy-increasing compressor under the working conditions of a small pressure ratio is solved.

The descriptions as described above are only preferred embodiments of the present disclosure, and are not used to limit the present disclosure. For those skilled in the art, the present disclosure may have various modifications and variants. Any modification, equivalent replacement, improvement and the like made within the spirit and principle of the present disclosure shall be included in the protection scope of the present disclosure.

What is claimed is:

1. A compressor, comprising:

a first cylinder provided with a first gas intake and a first gas outlet, the first gas outlet being configured to be connected to a predetermined heat exchanger;

a second cylinder provided with a second gas intake and a second gas outlet, the second gas outlet being configured to be connected to the predetermined heat exchanger;

a gas pre-exhausting device disposed on a cylinder block of the first cylinder, or on an upper end surface of the first cylinder, or on a lower end surface of the first cylinder, the gas pre-exhausting device comprising a pre-exhausting port and a first control valve that controls the pre-exhausting port to be open or closed, the pre-exhausting port being connected to the second gas intake;

a connecting passage, wherein a first end of the connecting passage is in communication with the first gas outlet, and a second end of the connecting passage is in communication with the second gas intake; and a switching control valve group disposed between the first cylinder and the second cylinder, and configured to enable the compressor to work in a double-stage enthalpy-increasing operating mode or a double-cylinder enthalpy-increasing operating mode or an unloaded operating mode.

2. The compressor according to claim 1, wherein the first cylinder and the second cylinder is any combination of a rotor cylinder, a piston cylinder, and a scroll cylinder.

3. The compressor according to claim 1, wherein the pre-exhausting port and the second gas intake are connected via an internal passage of the compressor or connected via a pipeline.

4. The compressor according to claim 1, wherein a volume ratio of the second cylinder to the first cylinder is in a range from 0.1 to 0.7.

5. The compressor according to claim 1, wherein the pre-exhausting port and the second gas intake are connected via an internal passage of the compressor or connected via a pipeline.

6. An air conditioner system, comprising the compressor of claim 1.

7. The air conditioner system according to claim 6, wherein a volume ratio of the second cylinder to the first cylinder is in a range from 0.1 to 0.7.

8. The air conditioner system according to claim 6, wherein the air conditioner system further comprises a gas-liquid separator, a first heat exchanger, a second heat exchanger, a first throttling element, and a second throttling element, wherein, an inlet of the first heat exchanger is connected to the first gas outlet and the second gas outlet; an outlet of the first heat exchanger is connected to an inlet of the first throttling element; an outlet of first throttling element is connected to an inlet of the gas-liquid separator; a bottom outlet of the gas-liquid separator is connected to an inlet of the second throttling element; an outlet of the second throttling element is connected to an inlet of the second heat exchanger; an outlet of the second heat exchanger is connected to the first gas intake; the first heat exchanger is the predetermined heat exchanger and a top outlet of the gas-liquid separator is connected to the second gas intake.

9. The air conditioner system according to claim 8, wherein the air conditioner system further comprises an unloaded operating mode, and when the air conditioner system is in the unloaded operating mode: a vapor injection valve on a top of the gas-liquid separator is closed; high-temperature and high-pressure gaseous refrigerant is transformed into high-pressure supercooled liquid refrigerant via the first heat exchanger, and then enters the gas-liquid separator via the first throttling element; all refrigerant in the gas-liquid separator is throttled into low-pressure two-phase refrigerant via the second throttling element; the low-pressure two-phase refrigerant enters the second heat exchanger and evaporates in the second heat exchanger, and then is drawn in the first cylinder; gas of the second cylinder all is drawn from exhausted gas of the gas pre-exhausting device; when a back pressure of a compression chamber of the first cylinder is greater than a suction pressure of the second cylinder, the first control valve of the gas pre-exhausting device opens, and is not closed until a first cylinder rotor of the first cylinder rotates and passes the pre-exhausting port of the gas pre-exhausting device.

10. The air conditioner system according to claim 8, wherein the air conditioner system comprises a double-cylinder enthalpy-increasing mode; when the air conditioner system is in the double-cylinder enthalpy-increasing mode, refrigerant is discharged from the first cylinder and the second cylinder of the compressor, and then is transformed into high-pressure supercooled liquid via the first heat exchanger, and enters the gas-liquid separator via the first throttling element; the refrigerant is divided into two flows in the gas-liquid separator; one flow of liquid refrigerant enters the second throttling element via the bottom outlet of the gas-liquid separator, and is throttled into low-pressure two-phase refrigerant, and then enters the second heat exchanger, and the low-pressure two-phase refrigerant evaporates into gaseous refrigerant in the second heat exchanger and is drawn in the first cylinder; another flow of refrigerant gas in the gas-liquid separator is mixed with refrigerant discharged from the gas pre-exhausting device via the top outlet of the gas-liquid separator, and then is drawn in the second cylinder.

11. The air conditioner system according to claim 10, wherein when the air conditioner system is in the double-cylinder enthalpy-increasing mode, a compression process of the first cylinder is as follows: the compression process of the first cylinder starts from a moment a first cylinder rotor rotates to an apex position of a first cylinder sliding vane; before the first cylinder rotor rotates and passes the first gas intake, the compression process has not started, and the first control valve of the gas pre-exhausting device is closed; when the first cylinder rotor rotates from a closed suction position to a position where a pressure in a compression chamber reaches an intermediate pressure, the first control valve of the gas pre-exhausting device is closed; when the first cylinder rotor rotates to a position where the pressure in the compression chamber is greater than the intermediate pressure, the first control valve of the gas pre-exhausting device opens, and a pre-exhausting process starts; when the first cylinder rotor rotates and passes the pre-exhausting port, the pre-exhausting process ends, and the compression chamber continues to compress; when the pressure in the compression chamber reaches an exhaust pressure of the first cylinder, an exhaust process of the first cylinder starts; and when the first cylinder rotor (114) rotates and passes the first gas outlet, the exhaust process of the first cylinder ends, and the entire cycle is completed.

12. The compressor according to claim 1, wherein the switching control valve group comprises:

a second control valve disposed on the connecting passage to control the connecting passage to be open or closed; and a third control valve disposed on a refrigerant pipe connecting the first gas outlet and the predetermined heat exchanger, and configured to control the refrigerant pipe to be open or closed;

wherein when the second control valve opens, and when the third control valve is closed, the first control valve is always closed because of a back pressure, and the compressor is in the double-stage enthalpy-increasing operating mode; when the second control valve is closed, and when the third control valve opens, and while a pressure in a compression chamber of the first cylinder is greater than an intermediate pressure of injected vapor, the first control valve opens because of a pressure difference, and part of refrigerant in the first cylinder is discharged and drawn in the second gas intake of the second cylinder, and the compressor is in the double-cylinder enthalpy-increasing operating mode; if the second control valve is closed, the third control valve opens, a vapor injection valve on a vapor injection branch is closed, and the pressure in the compression chamber of the first cylinder reaches back pressure of the pre-exhausting port, then the first control valve on the pre-exhausting port opens, and the compressor is in the unloading operating mode.

13. The compressor according to claim 12, wherein the second control valve and the third control valve both are cut-off valves.

14. An air conditioner system, comprising the compressor of claim 12.

15. The air conditioner system according to claim 14, wherein the air conditioner system further comprises a gas-liquid separator, a first heat exchanger, a second heat exchanger, a first throttling element, and a second throttling element, wherein, an inlet of the first heat exchanger is connected to the first gas outlet and the second gas outlet; an outlet of the first heat exchanger is connected to an inlet of the first throttling element; an outlet of first throttling element is connected to an inlet of the gas-liquid separator; a bottom outlet of the gas-liquid separator is connected to an inlet of the second throttling element; an outlet of the second throttling element is connected to an inlet of the second heat exchanger; an outlet of the second heat exchanger is connected to the first gas intake the first heat exchanger is the predetermined heat exchanger; and a top outlet of the gas-liquid separator is connected to the second gas intake.

16. The air conditioner system according to claim 15, wherein the air conditioner system comprises a double-stage enthalpy-increasing operating mode, and when the air conditioner system is in the double-stage enthalpy-increasing operating mode, the second control valve opens, and the third control valve is closed; since a back pressure applied on a valve plate of the first control valve of the gas pre-exhausting device is always greater than a pressure in a compression chamber corresponding to a position of the pre-exhausting port, the first control valve of the gas pre-exhausting device is always closed; in the double-stage enthalpy-increasing operating mode, refrigerant discharged from the first gas outlet is mixed with refrigerant flowing out from the top outlet of the gas-liquid separator and then is drawn in the second gas intake; high-temperature and high-pressure refrigerant discharged from the second gas outlet of the compressor is condensed by the first heat exchanger and is transformed into high-pressure supercooled liquid refrigerant; the high-pressure supercooled liquid refrigerant is throttled into a two-phase refrigerant via the first throttling element and enters the gas-liquid separator; the two-phase refrigerant is divided into two flows in the gas-liquid separator; liquid at a bottom flows out of the bottom outlet of the gas-liquid separator, and enters the second heat exchanger via the second throttling element; the liquid refrigerant evaporates into gaseous refrigerant in the second heat exchanger, and is drawn in the first cylinder; gas refrigerant in the gas-liquid separator flows out of the top outlet of the gas-liquid separator, and is mixed with refrigerant discharged from the first cylinder, and then drawn in the second gas intake; and a double-stage enthalpy-increasing compression of the refrigerant is realized.

17. The air conditioner system according to claim 15, wherein the air conditioner system further comprises an unloaded operating mode, and when the air conditioner system is in the unloaded operating mode, a vapor injection valve on the gas-liquid separator is closed; the second control valve is closed, and the third control valve opens; high-temperature and high-pressure gaseous refrigerant is transformed into high-pressure supercooled liquid refrigerant via the first heat exchanger; the high-pressure supercooled liquid refrigerant enters the gas-liquid separator via the first throttling element and is transformed into intermediate pressure refrigerant; all of the intermediate pressure refrigerant in the gas-liquid separator is throttled into low-pressure two-phase refrigerant via the second throttling element; the low-pressure two-phase refrigerant enters the second heat exchanger and evaporates in the second heat exchanger, and then is drawn in the first gas intake; when a back pressure of the compression chamber of the first cylinder is greater than a suction pressure of the second cylinder, the first control valve opens, and is not closed until a first cylinder rotor of the first cylinder rotates and passes the pre-exhausting port.

18. The air conditioner system according to claim 15, wherein the air conditioner system further comprises a double-cylinder enthalpy-increasing operating mode, and when the air conditioner system is in the double-cylinder enthalpy-increasing operating mode, the second control valve is closed, and the third control valve opens; when a pressure in a compression chamber of the first cylinder is greater than a back pressure applied on the gas pre-exhausting device, the first control valve of the gas pre-exhausting device opens, and is not closed until a first cylinder rotor of the first cylinder rotates and passes the gas pre-exhausting device; in the double-cylinder enthalpy-increasing operating mode, refrigerant is discharged from the compressor, and then is transformed into high-pressure supercooled liquid via the first heat exchanger; the high-pressure supercooled liquid enters the gas-liquid separator via the first throttling element, and is divided into two flows in the gas-liquid separator; one flow of liquid refrigerant enters the second throttling element via the bottom outlet of the gas-liquid separator and is throttled into low-pressure two-phase refrigerant; the low-pressure two-phase refrigerant enters the second heat exchanger and evaporates into gaseous refrigerant in the second heat exchanger; the gaseous refrigerant is drawn in the first gas intake; another flow of gas refrigerant in the gas-liquid separator flows out of the top outlet of the gas-liquid separator and is mixed with refrigerant discharged from the gas pre-exhausting device, and then is drawn in the second gas intake.

19. The air conditioner system according to claim 18, wherein when the air conditioner system is in the double-cylinder enthalpy-increasing operating mode, a compression process of the first cylinder is as follows: the compression process of the first cylinder starts from a moment a first cylinder rotor rotates to an apex position of a first cylinder sliding vane; before the first cylinder rotor rotates and passes the first gas intake, the compression process has not started, and the first control valve of the gas pre-exhausting device is closed; when the first cylinder rotor rotates from a closed suction position to a position between the closed suction position and a position where the pressure in the compression chamber reaches an intermediate pressure; the first control valve is closed; and when the first cylinder rotor rotates to a position where the pressure in the compression chamber is greater than the intermediate pressure, the first control valve opens, and a pre-exhausting process starts; as a rotation angle of the first cylinder rotor increases, the pressure in the compression chamber remains unchanged, and the first control valve is still open; when the first cylinder rotor rotates and passes the pre-exhausting port of the gas pre-exhausting device, the pre-exhausting process ends; the compression chamber continues to compress; when the pressure in the compression chamber reaches an exhaust pressure of the first gas outlet, an exhaust process starts; when the first cylinder rotor rotates and passes the first gas outlet, the exhaust process ends, and an entire cycle is completed.

* * * * *